US006325686B1

(12) United States Patent
Funami

(10) Patent No.: US 6,325,686 B1
(45) Date of Patent: Dec. 4, 2001

(54) TILT DEVICE FOR MARINE PROPULSION UNIT

(75) Inventor: Yasuo Funami, Saitama (JP)

(73) Assignee: Showa Corporation (JP)

( * ) Notice: Subject to any disclaimer, the term of this patent is extended or adjusted under 35 U.S.C. 154(b) by 0 days.

(21) Appl. No.: 09/716,580

(22) Filed: Nov. 20, 2000

(30) Foreign Application Priority Data

Mar. 22, 2000 (JP) ..... 12-080910

(51) Int. Cl.[7] ..... B63H 5/125
(52) U.S. Cl. ..... 440/61
(58) Field of Search ..... 440/55, 56, 61, 440/900

(56) References Cited

U.S. PATENT DOCUMENTS 5,358,436 * 10/1994 Soda et al. ..... 440/61
6,146,220 * 11/2000 Alby et al. ..... 440/61
6,276,976 * 8/2001 Saito ..... 440/61

FOREIGN PATENT DOCUMENTS 3588 1/1991 (JP) .

* cited by examiner

*Primary Examiner*—Stephen Avila
(74) *Attorney, Agent, or Firm*—Orum & Roth

(57) ABSTRACT

In a tilt device for a shift propelling machine, a hydraulic fluid supply/discharge device, a pump unit including an integral motor, and a tank is integrally provided in a swivel bracket.

18 Claims, 9 Drawing Sheets

TILT DEVICE FOR MARINE PROPULSION UNIT

BACKGROUND OF THE INVENTION

1. Field of the Invention

The present invention relates to a tilt device for a marine propulsion unit.

2. Description of the Related Art

Conventionally, there has been a tilt device for a marine propulsion unit having a clamp bracket fixed to a ship side, a swivel bracket connected to the clamp bracket in such a manner as to freely tilt, a cylinder device interposed between the clamp bracket and the swivel bracket and a hydraulic fluid supply/discharge device expanding and compressing the cylinder device, structured such that a propelling unit is supported to the swivel bracket, as shown in Japanese Unexamined Patent Publication (JP-A) No. 3-588.

The prior art has the following problems:

(1) Since the hydraulic fluid supply/discharge device is provided in such a manner as to be independent from the clamp bracket and the swivel bracket, the number of the parts is increased and the number of steps in the mounting process is increased.

(2) Since the cylinder of a trim cylinder constituting the cylinder device is also mounted in such a manner as to be independent from the clamp bracket and the swivel bracket, the number of the parts is increased and the number of steps in the mounting process is increased.

SUMMARY OF THE INVENTION

An object of the present invention is to provide a tilt device for a marine propulsion unit in which the number of the parts is reduced and the number of steps in the mounting process is reduced.

In accordance with the present invention, there is a tilt device provided for a marine propulsion unit comprising a clamp bracket fixed to a ship side, a swivel bracket connected to the clamp bracket in such a manner as to freely tilt, a cylinder device interposed between the clamp bracket and the swivel bracket and a hydraulic fluid supply/discharge device expanding and compressing the cylinder device, structured such that a propelling unit is supported by the swivel bracket, wherein the hydraulic fluid supply/discharge device is integrally provided with the clamp bracket or the swivel bracket.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings:

FIGS. 6A and 6B show a damp bracket, in which FIG. 6A is a front elevational view and FIG. 6B is a side elevational view;

DESCRIPTION OF THE PREFERRED EMBODIMENTS

First Embodiment (FIGS. 1 to 8)

Figure 1:
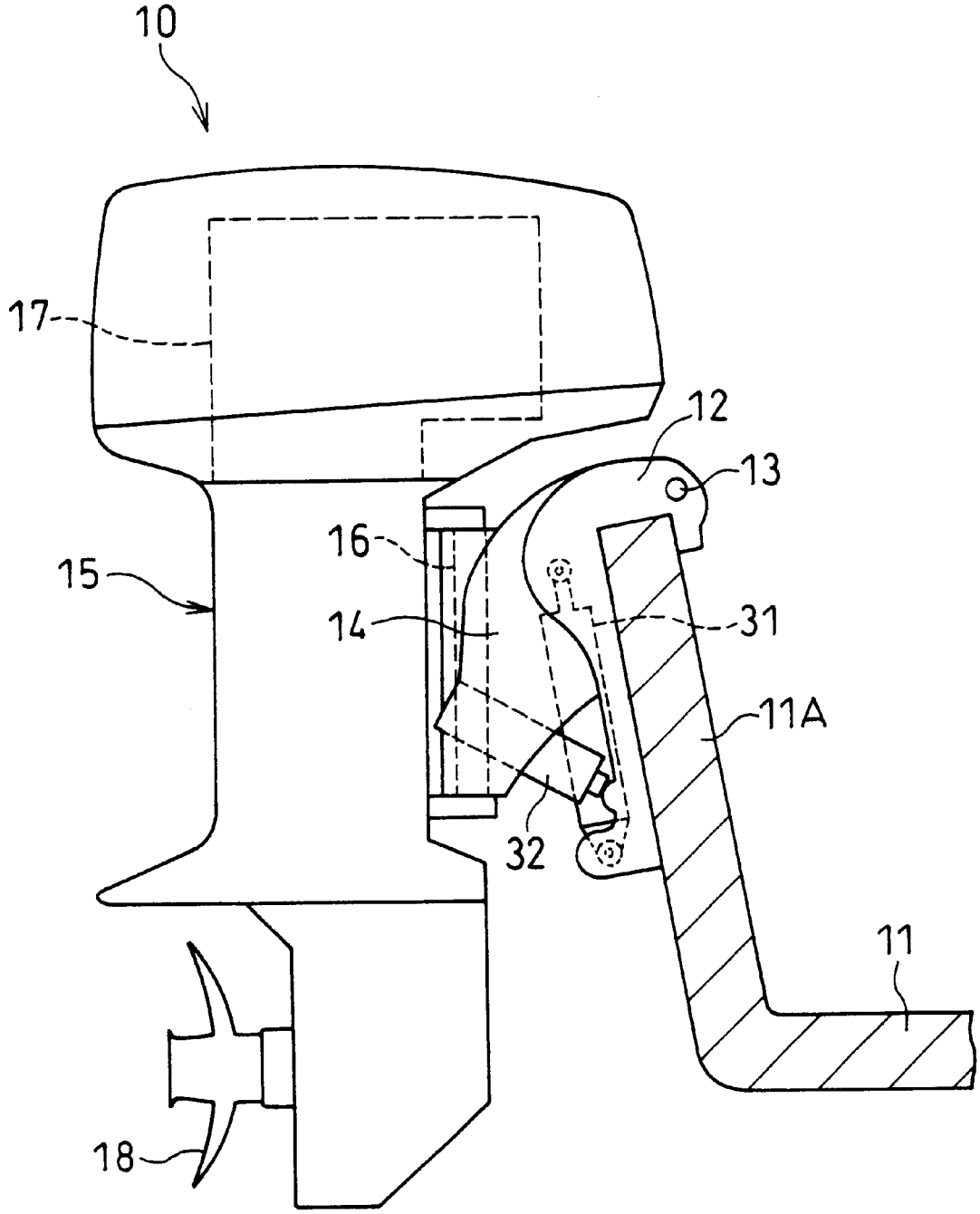
FIG. 1 is a schematic view showing a marine propulsion unit in accordance with a first embodiment.
Figure 2:
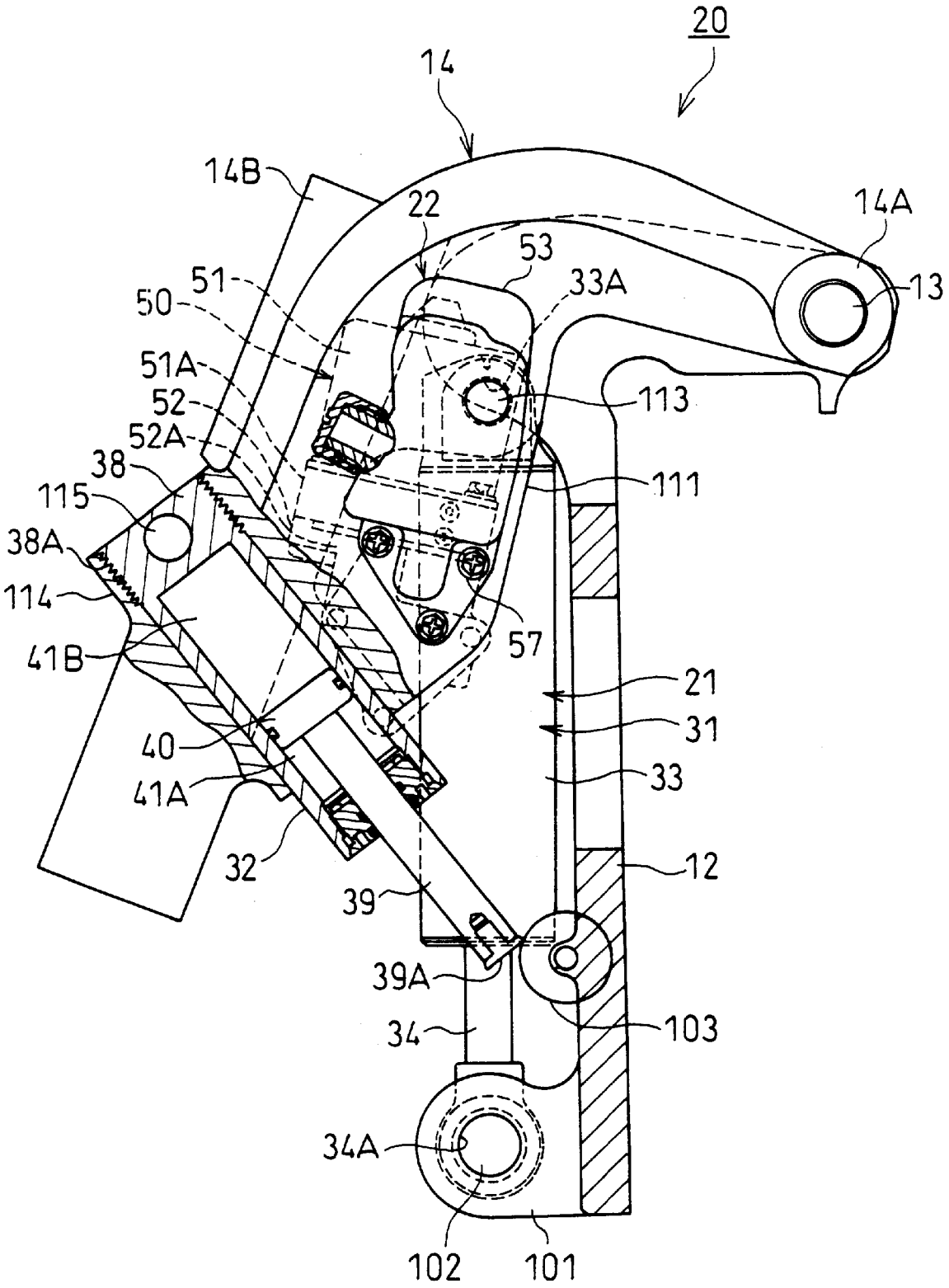
FIG. 2 is a side elevational view showing a tilt device.
Figure 3:
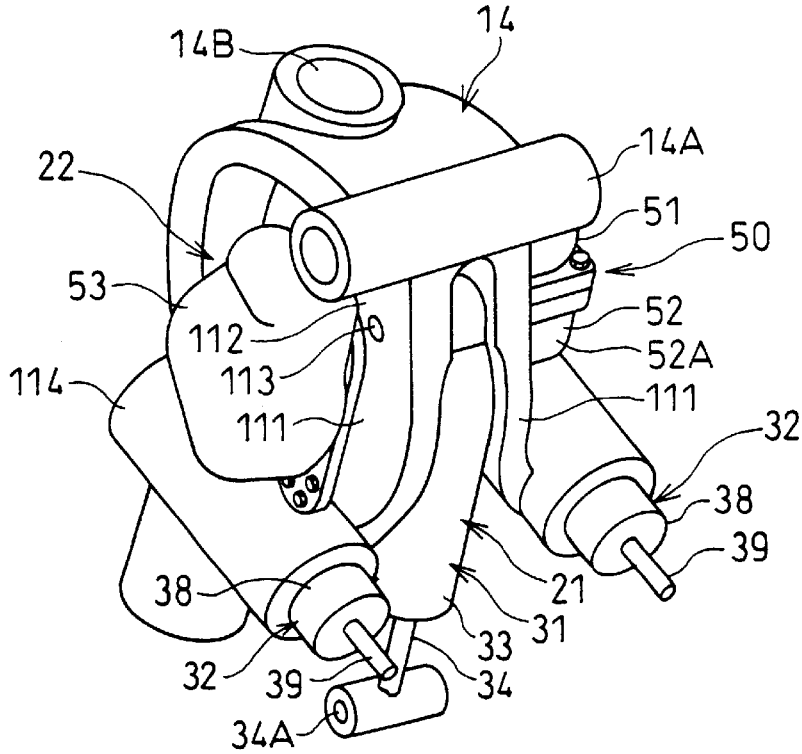
FIG. 3 is a perspective view showing a sub-assembly in which a cylinder device and a hydraulic fluid supply/discharge device are mounted to a swivel bracket.
Figure 4:
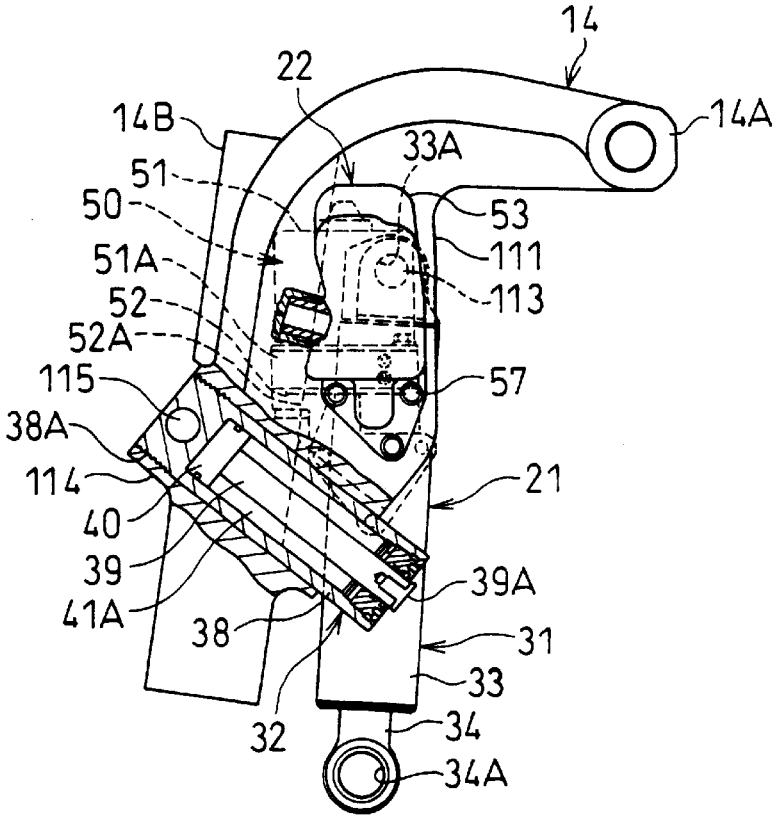
FIG. 4 is a side elevational view of FIG. 3.

A marine propulsion unit 10 (an outboard engine, however, an inboard outboard engine may be available) is structured, as shown in FIGS. 1 and 2, such that a propelling unit 15 can be mounted to a hull 11 by a tilt and trim device 20. The tilt and trim device 20 has a clamp bracket 12 provided with a tilt shaft supporting portion 12A fixed to a stern plate 11A of the hull 11 and supporting a tilt shaft 13, and a swivel bracket 14 provided with a tilt shaft supporting portion 14A pivoted to the tilt shaft 13 and connected so as to be freely tilted around a substantially horizontal axis of the tilt shaft 13. A cylinder device 21 is interposed between the cramp bracket 12 and the swivel bracket 14, and a hydraulic fluid supply/discharge device 22 for expanding and compressing the cylinder device 21. The marine propulsion unit 10 supports the propelling unit 15 via a rudder shaft 16 supported to a rudder shaft supporting portion 14B of the swivel bracket 14 in such a manner as to rotate around the rudder shaft 16. An engine unit 17 is mounted to an upper portion of the propelling unit 15, and a propeller 18 is provided in a lower portion of the propelling unit 15.

Figure 5:
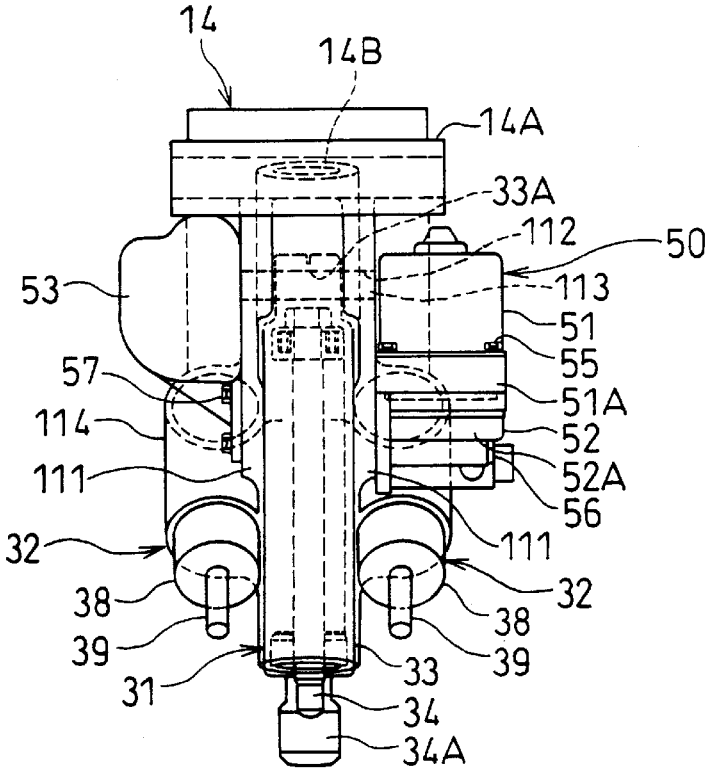
FIG. 5 is a front elevational view of FIG. 3.
Figure 6A:
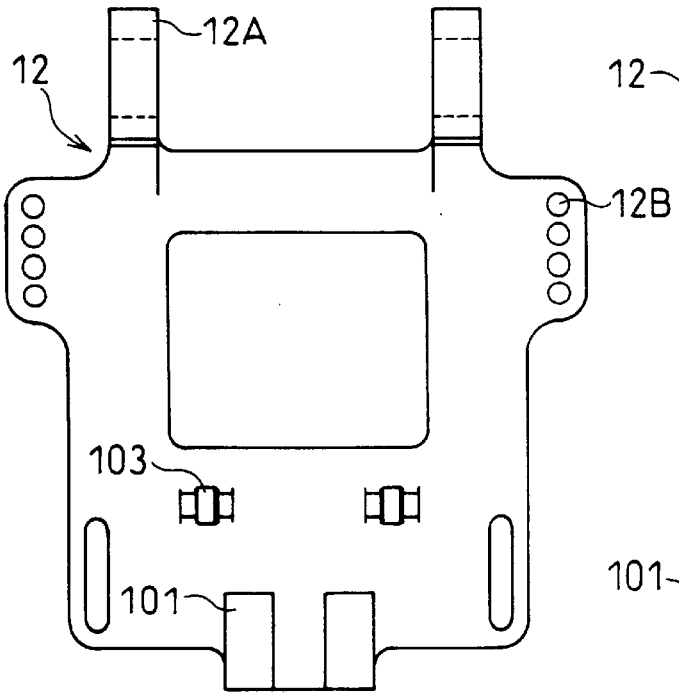
Figure 6B:
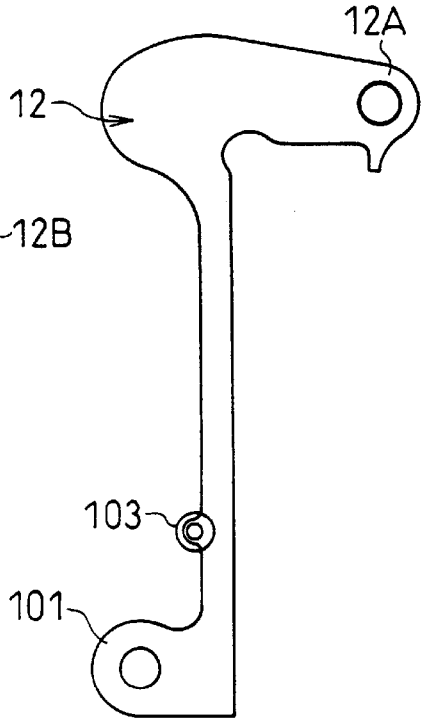

In this case, the clamp bracket 12 is formed in a substantially flat plate shape as shown in FIG. 6, and is made in an aluminum alloy casting process. The clamp bracket 12 and is provided with a bolt mounting hole 12B for mounting to the stern plate 11A. Further, the swivel bracket 14 is made of an aluminum alloy casing, is formed in a shape shown in FIGS. 3 to 5, and is integrally provided with a cylinder 38 of a trim cylinder 32 mentioned below constituting the cylinder device 21, a pump unit 50 (a motor 51 and a pump 52) constituting the hydraulic fluid supply/discharge device 22 and a tank 53.

Cylinder Device 21

(FIGS. 2 to 5 and 8)

The cylinder device 21 of the tilt and trim device 20 is, as shown in FIGS. 2 to 5, constituted by a central tilt cylinder 31 and a pair of right and left trim cylinders 32.

The tilt cylinder 31 is, as shown in FIGS. 2 to 5 and 8, constituted by a cylinder 33 and a piston rod 34. The cylinder 33 is provided with a mounting pin inserting and attaching hole 33A for a mounting pin 113 mounted to a pin mounting portion 112 provided on each of right and left mounting walls 111 of the swivel bracket 14. The piston rod 34 is provided with a mounting pin inserting and attaching hole 34A for a mounting pin 102 mounted to a pin mounting portion 101 (FIG. 6) provided in the clamp bracket 12. The tilt cylinder 31 is sectioned into a rod side chamber 36A in a side receiving the piston rod 34 and a piston side chamber 36B in a side not receiving the piston rod 34 by the piston 35 fixed to an end portion of the piston rod 34. An absorber valve 37 for absorbing an impact force is provided in the piston 35.

The trim cylinder 32 is constituted by a cylinder 38 and a piston rod 39, as shown in FIGS. 2 to 5 and 8. The cylinder 38 is structured such that a base end screw portion 38A thereof is engaged with a hole-like cylinder mounting portion 114 provided in right and left portions of the swivel bracket 14, and is inserted, attached and fixed such that a front end portion thereof is inclined downward, thereby being integrally provided with the swivel bracket 14. The piston rod 39 is structured such that a front end alignment portion 39A thereof can be brought into contact with roller-like thrust receivers 103 provided right and left of the clamp bracket 12 in a state capable of moving apart from each other (FIG. 6). The trim cylinder 32 is sectioned into a rod side chamber 41A receiving the piston rod 39 and a piston side chamber 41B not receiving the piston rod 39 by the piston 40 fixed to an end portion of the piston rod 39.

The cylinder device 21 is structured such that the cylinder 33 of the tilt cylinder 31 and the cylinder 38 of the trim cylinder 32 are made in an aluminum alloy casting process.

In this case, the cylinder 38 of the trim cylinder 32 is inserted, attached, and fixed to the hole-like cylinder mounting portion 114 mentioned above of the swivel bracket 14, and is fixed to the swivel bracket 14 by a pin 115, a bolt, or the like, so as to be integrally provided, or may be integrally formed with the swivel bracket 14 in accordance with a casting process.

Hydraulic Fluid Supply/Discharge Device 22
(FIGS. 2 to 5 and 8)

The hydraulic fluid supply/discharge device 22 is constituted by a pump unit 50 comprising a reversible type motor 51 and a reversible type gear pump 52, a reservoir tank 53, and a flow passage with a switching valve 54.

In accordance with the present embodiment, a pump chamber (not shown) for receiving the pump 52 is formed in a pump housing 52A, and an end plate 51A of the motor 51 is fixed to an upper portion of the pump chamber in the pump housing 52A by a bolt 55, thereby forming the pump unit 50. The pump unit 50 is structured such that the pump housing 52A is fixed to one of the right and left mounting walls 111 of the swivel bracket 14 by a bolt 56, thereby being integrally provided in the swivel bracket 14. The tank 53 is fixed to another of the right and left mounting walls 111 of the swivel bracket 14 by a bolt 57, thereby being integrally provided in the swivel bracket 14.

Figure 8:
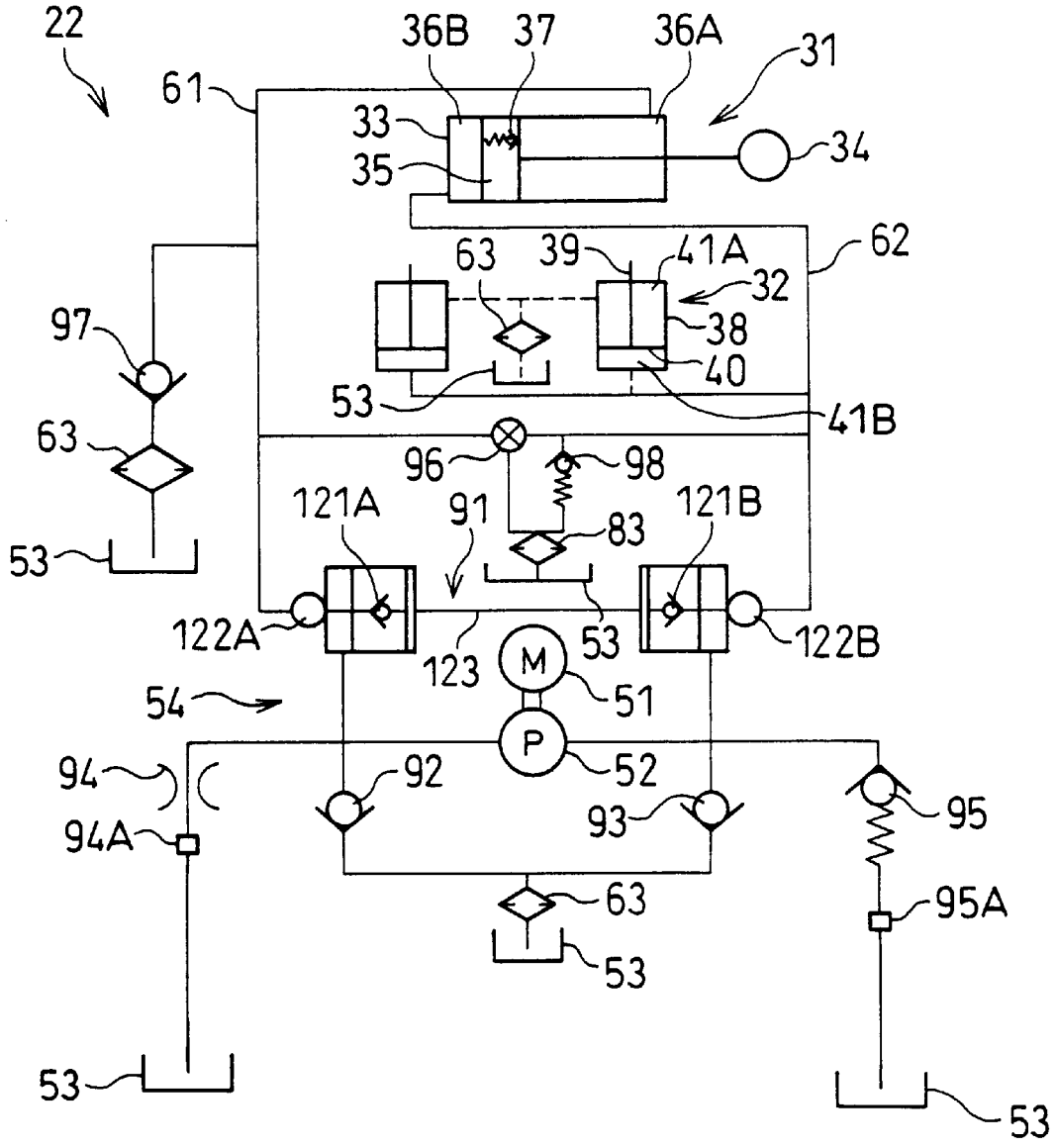
FIG. 8 is a hydraulic circuit diagram.

The pump 52, the tank 53, the rod side chamber 36A of the tilt cylinder 31, the piston side chamber 36B, the rod side chamber 41A of the trim cylinder 32 and the piston side chamber 41B are connected by the flow passage with the switching valve 54 which may be in fluid connection with the swivel bracket 14, the pump housing 52A or the like, thereby enabling a reduction in the number of independent pipes. The flow passage with the switching valve 54 is, as shown in FIG. 8, provided with a first oil passage 61 and a second oil passage 62 respectively communicating the pump 52 with the rod side chamber 36A of the tilt cylinder 31 and the piston side chamber 36B, thereby communicating a middle portion of the second oil passage 62 with the piston side chamber 41B of the trim cylinder 32. In this case, the rod side chamber 41A of the trim cylinder 32 is communicated with the tank 53 via the filter 63.

Figure 7:
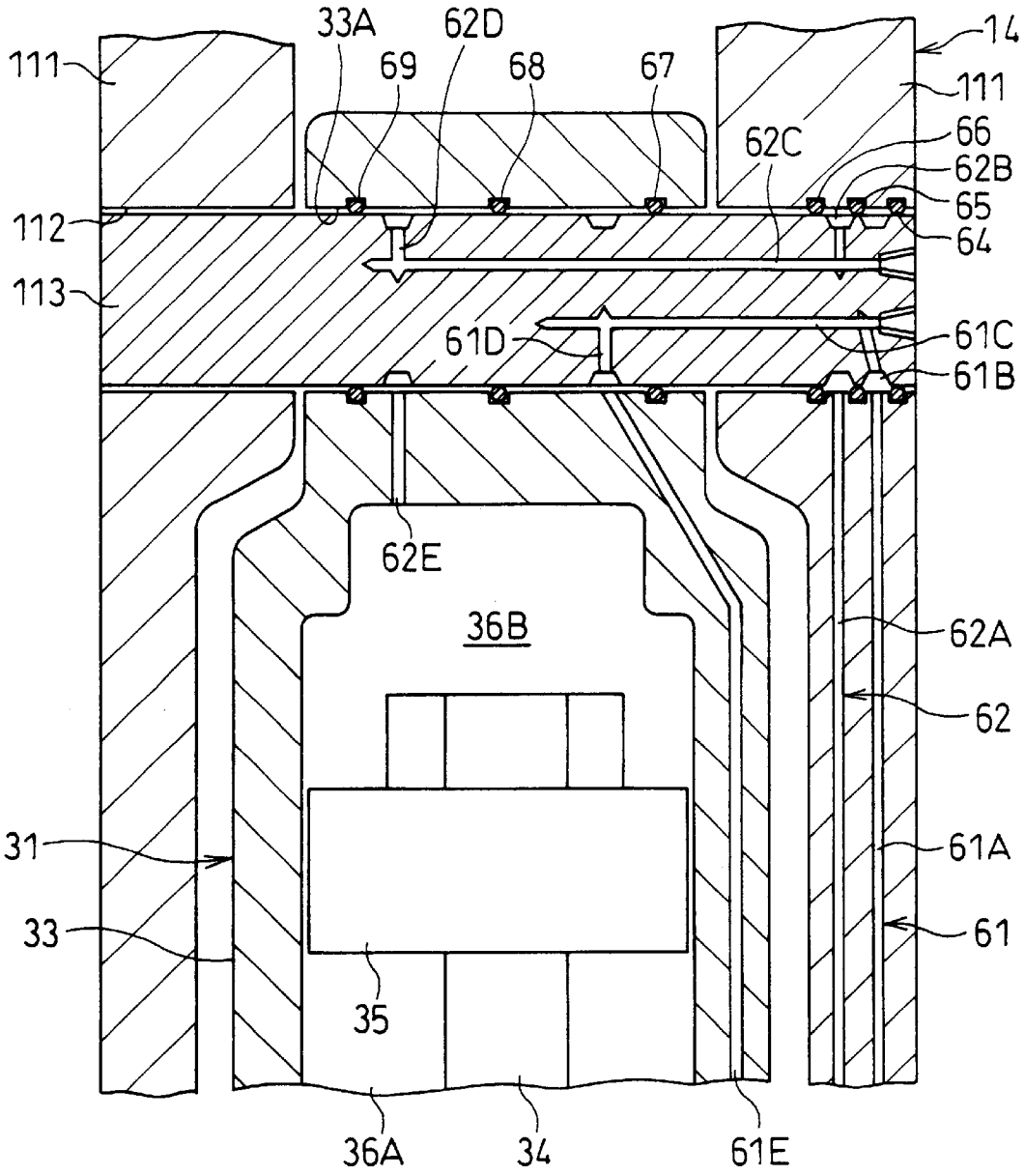
FIG. 7 is a cross sectional view showing an oil path installed in a mounting pin of a tilt cylinder.

In accordance with the present embodiment, the pump unit 50 and the tank 53 are integrally provided in the swivel bracket 14, and the cylinder 33 of the tilt cylinder 31 is mounted to the mounting wall 111 of the swivel bracket 14 via the mounting pin 113. The first oil passage 61 communicated with the rod side chamber 36A of the tilt cylinder 31 from the pump 52 is formed by communicating an oil passage 61A provided in the swivel bracket 14, an oil passage 61B provided on an outer periphery of the mounting pin 113, an oil passage 61C provided in an axial direction of the mounting pin 113, an oil passage 61D provided on an outer periphery of the mounting pin 113 and an oil passage 61E provided in an axial direction of the cylinder 33 with each other, as shown in FIG. 7. Further, the second oil passage 62 communicated with the piston side chamber 36B of the tilt cylinder 31 from the pump 52 is formed by communicating an oil passage 62A provided in the swivel bracket 14, an oil passage 62B provided on the outer periphery of the mounting pin 113, an oil passage 62C provided in an axial direction of the mounting pin 113, an oil passage 62D provided on the outer periphery of the mounting pin 113 and an oil passage 62E provided in an axial direction of the cylinder 33 with each other, as shown in FIG. 7. The oil passages 61B and 62B provided on the outer periphery of the mounting pin 113 are sealed by O-rings 64, 65 and 66 attached to an O-ring groove on an inner periphery of the pin mounting portion 112 of the mounting wall 111 in the swivel bracket 14 to which the mounting pin 113 is attached. The oil passages 61D and 62D provided on the outer periphery of the mounting pin 113 are sealed by O-rings 67, 68 and 69 attached to an O-ring groove on an inner periphery of the mounting pin attaching hole 33A in the cylinder 33 to which the mounting pin 113 is attached.

At this time, the flow passage with the switching valve 54 is, as shown in FIG. 8, provided with a shuttle type switching valve 91, check valves 92 and 93, a down blow valve 94, an up blow valve 95, a manual valve 96, a check valve 97 and a thermal blow valve 98.

The shuttle type switching valve 91 is provided with a first check valve 122A and a second check valve 122B positioned in both sides of a spool with a first check mechanism 121A and a spool with a second check mechanism 121B, and connects the spool 121A to the spool 121B by a flow passage 123. At a time when the pump 52 normally rotates, the first check valve 122A performs an open operation due to pressure of the fed oil, and pressure of the fed oil passing through the check mechanism in the spool with the first check mechanism 121A moves the spool with the second check mechanism 121B so as to perform an open operation of the second check valve 122B in an opposite side. At a time when the pump 52 reverse rotates, the second check valve 122B performs an open operation due to pressure of the fed oil, and a pressure of the fed oil passing through the check mechanism in the spool with the second check mechanism 121B moves the spool with the first check mechanism 121A so as to perform an open operation of the first check valve 122A in an opposite side.

The check valve 92 is interposed in a middle portion between the pump 52 and the tank 53. Since an internal volume of the cylinders 33 and 38 is increased with the moving-out volume of the piston rods 34 and 39, and an amount of circulating oil in the working fluid becomes insufficient at a time when the cylinder device 21 is tilted up, the insufficient amount of the circulating oil is supplemented to the pump 52 from the tank 53 in accordance with the open operation of the check valve 92.

The check valve 93 is interposed in a middle portion between the pump 52 and the tank 53, and is structured such that the working fluid can be supplied to the pump 52 from the tank 53 in accordance with the open operation of the check valve 93 in the case that the pump 52 is operated when the tilt down operation of the cylinder device 21 is finished and the oil is not returned to the pump 52 from the piston side chambers 36B and 41B.

The down blow valve 94 is constituted by an orifice, and is structured to return excess working fluid to the tank 53 from a discharge port 94A when the internal volume of the cylinders 33 and 38 is reduced during a moving-inward volume of the piston rods 34 and 39, and an amount of the circulating oil in the working fluid generates a surplus at a time of tilting down the cylinder device 21.

The up blow valve 95 is structured such as to return the excess working fluid to the tank 53 from a discharge port 95A when the pump 52 is still operated after the tilt cylinder 31 reaches an extending state and the tilt-up operation is completed during tilting up of the cylinder device 21.

The manual valve 96 is manually operated at a time of trouble in the tilt and trim device 20 so as to return the working fluid in the piston side chambers 36B and 41B of the cylinder device 21 to the tank 53, thereby manually compressing the cylinder device 21 together with operation of the check valve 97 and manually tilting down the propelling unit 15.

The check valve 97 is structured to take the working fluid in the tank 53 into the rod side chamber 36A of the cylinder device 21 during use of the manual valve 96, thereby manually compressing the cylinder device 21.

The thermal blow valve 98 serves a thermal blow function of releasing the working fluid having an increased volume to the tank 53 at a time when the volume of the working fluid in the piston side chambers 36B and 41B and the second oil passage 62 of the cylinder device 21 is increased due to a temperature change.

In this case, the pump housing 52A and the tank 53 for the pump unit 50 are integrally provided in the swivel bracket 14 in accordance with a bolt connection, or may be integrally formed with the swivel bracket 14 in accordance with a casting process.

Therefore, in accordance with the present embodiment, the following effects can be obtained.

(1) Since the hydraulic fluid supply/discharge device 22 is integrally provided in the swivel bracket 14, it is possible to reduce the number of the parts and reduce the number of the process steps for mounting.

(2) The hydraulic fluid supply/discharge device 22 is constituted by the pump unit 50 including the motor 51U, so as to be united, and the tank 53, and each of the pump unit 50 and the tank 53 is integrally provided with the swivel bracket 14. Each of the pump unit 50 and the tank 53 can be attached and detached in a unit. The number of the process steps for mounting can be reduced, and removal and replacement for purposes is facilitated, as it is unnecessary for repair purposes to replace the entire hydraulic fluid supply/discharge device 22.

(3) Since the cylinder 38 of the trim cylinder 32 is integrally provided in the swivel bracket 14, it is possible to reduce the number of parts and the number of process steps for mounting.

(4) In the case that the cylinder 38 of the trim cylinder 32 is integrally formed with the swivel bracket 14, it is possible to reduce the number of parts and the number of the process steps for mounting and it is possible to reduce weight, in comparison with the structure in which the cylinder 38 of the trim cylinder 32 is prepared as an independent part from the bracket.

(5) Since the flow passage with the switching valve 54 connecting the hydraulic fluid supply/discharge device 22, the tilt cylinder 31 of the cylinder device 21 and the trim cylinder 32 is installed within the swivel bracket 14, it is possible to reduce the number of external pipe elements.

(6) Since the flow passage with the switching valve 54 (the first oil passage 61 and the second oil passage 62) connecting the hydraulic fluid supply/discharge device 22 to the tilt cylinder 31 is installed within the mounting pin 113 of the tilt cylinder 31, it is possible to reduce the external pipe.

Figure 9:
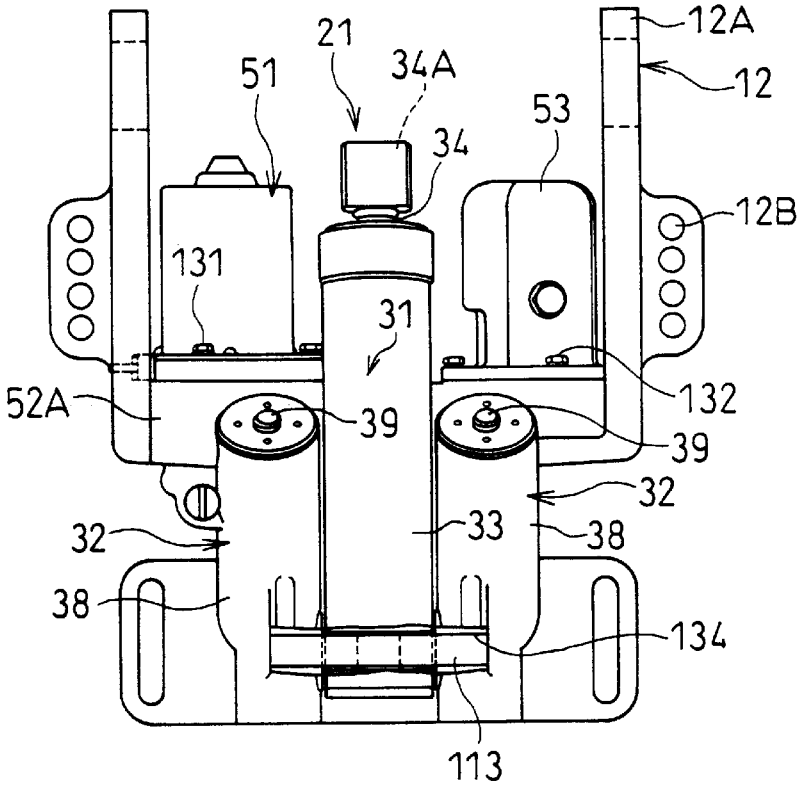
FIG. 9 is a front elevational view showing a sub-assembly in which a cylinder device and a hydraulic fluid supply/discharge device are mounted to a clamp bracket in accordance with the second embodiment.
Figure 10:
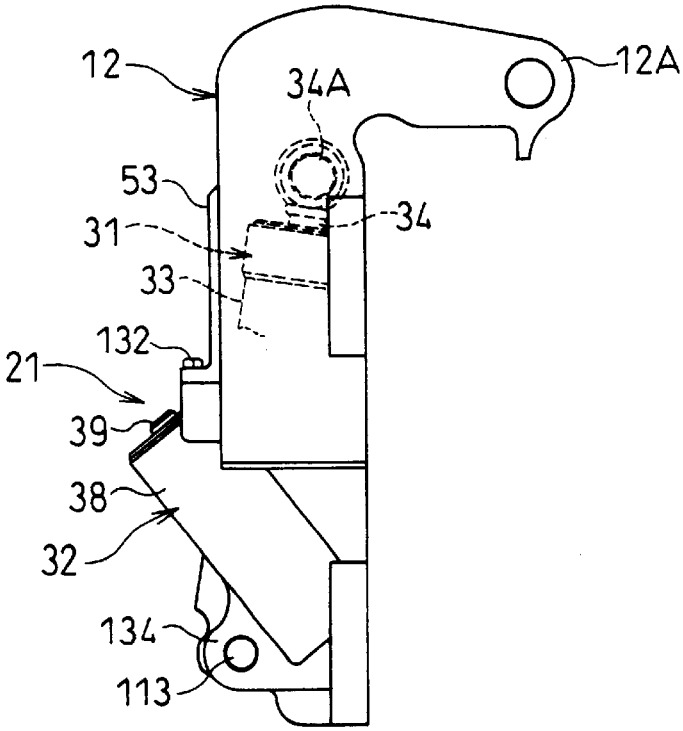
FIG. 10 is a side elevational view of FIG. 9.

Second Embodiment (FIGS. 9 and 10)

Points at which a second embodiment is different from the first embodiment are as follows.

(a) The hydraulic fluid supply/discharge device 22 is integrally provided in the clamp bracket 12. In particular, a portion of the pump housing 52A forming the pump chamber (not shown) for receiving the pump 52 is integrally formed in the clamp bracket 12 in accordance with a casting process. The motor 51 is integrally provided in an upper portion of the pump housing 52A by attachment of a bolt 131, and the tank 53 is integrally provided in the clamp, bracket 12 by attachment of a bolt 132.

In this case, the pump housing 52A independently formed from the clamp bracket 12 may be integrally provided by a bolt connecting to the clamp bracket 12 or the like. Further, the tank 53 may be integrally formed with the clamp bracket 12 in accordance with a casting process.

(b) The cylinder 38 of the trim cylinder 32 is integrally formed with the clamp bracket 12 in accordance with a casting process. In this case, the structure obtained by independently forming the cylinder 38 of the trim cylinder 32 from the clamp bracket 12 may be inserted, attached and fixed to the clamp bracket 12 by pin or bolt connection or the like. At this time, a roller-like thrust receiver for the front end alignment portion 39A of the piston rod 39 in the trim cylinder 32 can be provided right and left of the swivel bracket 14.

(c) The pump 52, the tank 53, the rod side chamber 36A and the piston side chamber 36B of the tilt cylinder 31, the rod side chamber 41A and the piston side chamber 41B of the trim cylinder 32 are connected by the flow passage with the switching valve 54 in fluid connection in the clamp bracket 12. Further, the cylinder 33 of the tilt cylinder 31 is mounted to a pin mounting portion 134 of the clamp bracket 12 via a mounting pin 133, whereby the first oil passage 61 and the second oil passage 62 for connecting the pump 52 and the tank 53 to the rod side chamber 36A of the tilt cylinder 31 and the piston side chamber 36B thereof can be installed with the clamp bracket 12, the mounting pin 133 and the cylinder 33.

Figure 11:
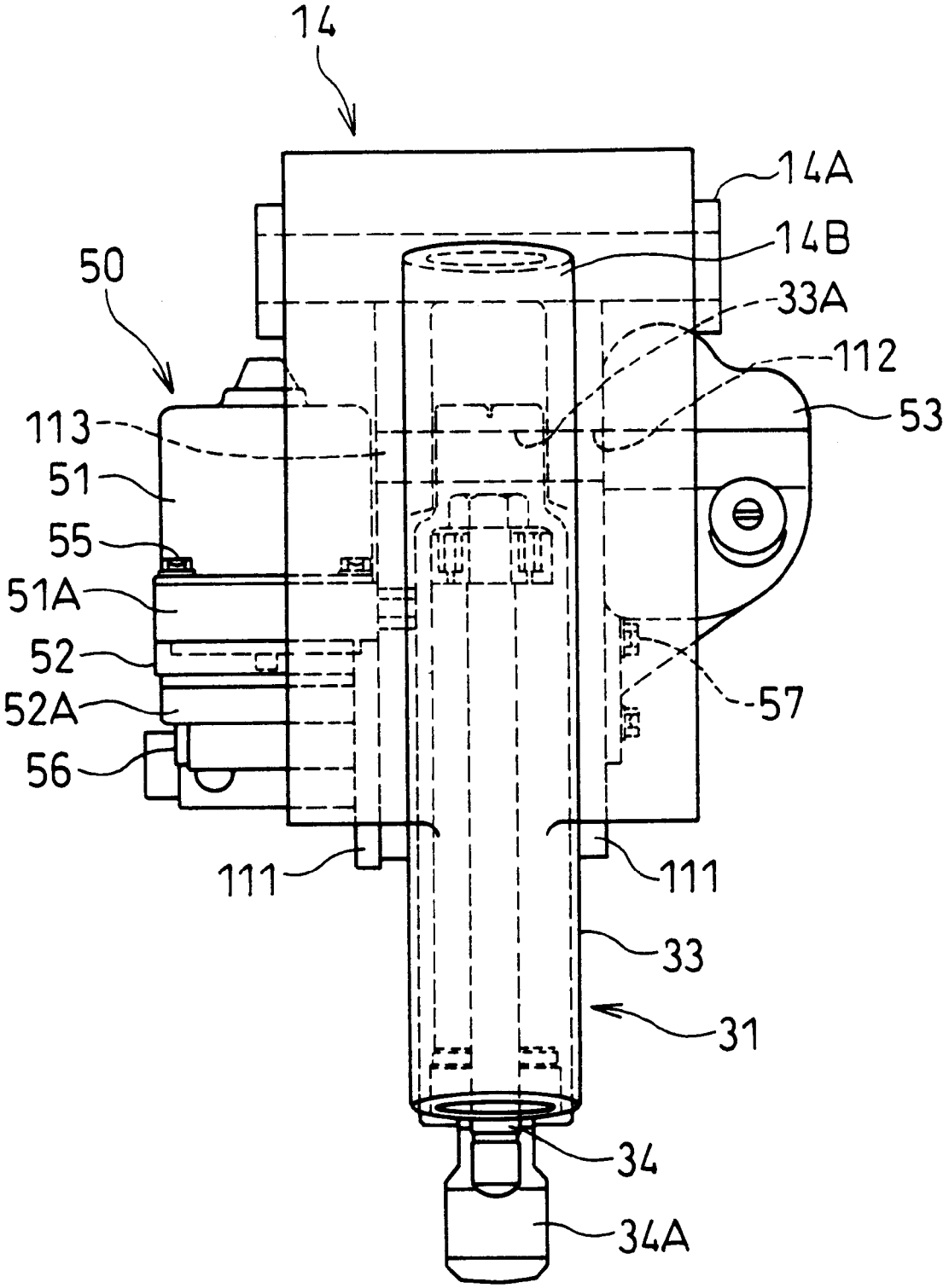
FIG. 11 is a back elevational view showing a sub-assembly in which a hydraulic fluid supply/discharge device is mounted to a swivel bracket in accordance with a third embodiment.

Third Embodiment (FIG. 11)

A point at which the third embodiment is different from the first embodiment is that the trim cylinder 32 is taken out from the sub-assembly of the swivel bracket 14 shown in FIG. 5 corresponding to the first embodiment, that is, only the hydraulic fluid supply/discharge device 22 is integrally provided in the swivel bracket 14. The hydraulic fluid supply/discharge device 22 is constituted by the pump unit 50 including the motor 51 which is united, and the tank 53. The pump housing 52A of the pump unit 50 is fixed to one of the right and left mounting walls 111 of the swivel bracket 14 by the bolt 55. The tank 53 is fixed to another of the right and left mounting walls 111 of the swivel bracket 14 by the bolt 57. According to the above, the hydraulic fluid supply/discharge device 22 is integrally provided in the swivel bracket 14.

Figure 12:
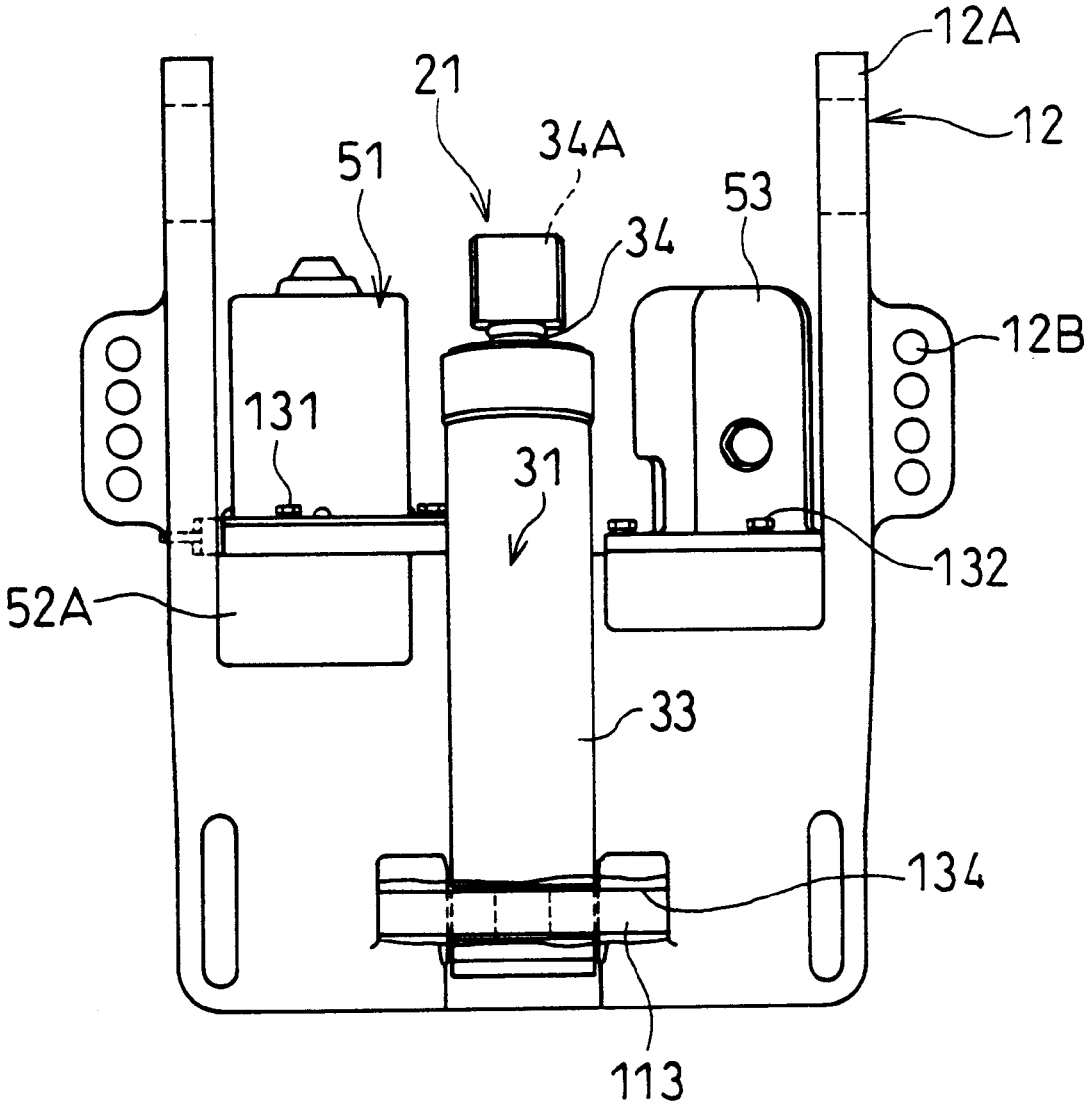
FIG. 12 is a front elevational view showing a sub-assembly in which a hydraulic fluid supply/discharge device is mounted to a clamp bracket in accordance with a fourth embodiment.

Fourth Embodiment (FIG. 12)

A point at which the fourth embodiment is different from the second embodiment is that the trim cylinder 32 is taken out from the sub-assembly of the clamp bracket 12 shown in FIG. 9 corresponding to the second embodiment. Only the hydraulic fluid supply/discharge device 22 is integrally provided in the clamp bracket 12. The hydraulic fluid supply/discharge device 22 is structured such that the portion of the pump housing 52A is integrally formed with the clamp bracket 12 in accordance with a casting process, the motor 51 is integrally provided in the upper portion of the pump housing 52A by attachment of the bolt 131, and the tank 53 is integrally provided in the clamp bracket 12 by attachment of the bolt 132.

As heretofore explained, embodiments of the present invention have been described in detail with reference to the drawings. However, the specific configurations of the present invention are not limited to the embodiments but those having a modification of the design within the range of the appended claims are also included in the present invention. For example, the connection between the pump 52, the tank 53, the rod side chamber 36A of the tilt cylinder 31, the piston side chamber 36B, the rod side chamber 41A of the trim cylinder 32 and the piston side chamber 41B is not limited to the flow path created by a fluid connection in the clamp bracket 12, the swivel bracket 14 or the like, and may employ a normal flexible pipe (an external pipe).

As mentioned above, in accordance with the present invention, in the tilt device for the marine propulsion unit, it is possible to reduce the number of parts and reduce the number of the process steps mounting.

Although the invention has been illustrated and described with respect to several exemplary embodiments thereof, it should be understood by those skilled in the art that the foregoing and various other changes, omissions and additions may be made to the present invention without departing from the spirit and scope thereof Therefore, the present invention should not be understood as limited to the specific embodiment set out above, but should be understood to include all possible embodiments which can be embodied within the scope encompassed and equivalents thereof with respect to the features set out in the appended claims.

What is claimed is:

1. A tilt device for a marine propulsion unit comprising a clamp bracket fixed to a ship side, a swivel bracket connected to the clamp bracket in such a manner as to freely tilt, the clamp bracket or the swivel bracket forming an attachment apparatus, a cylinder device interposed between the clamp bracket and the swivel bracket and a hydraulic fluid supply/discharge device expanding and compressing the cylinder device, the propelling unit being in supported connection with the swivel bracket, wherein the hydraulic fluid supply/discharge device is integral with the attachment apparatus.

2. A tilt device for a marine propulsion unit as claimed in claim 1, wherein said hydraulic fluid supply/discharge device comprises a pump unit integral with a motor, and a tank, wherein the pump unit and the tank are integral with the attachment apparatus.

3. A tilt device for a marine propulsion unit as claimed in claim 1, wherein said cylinder device comprises a tilt cylinder and a trim cylinder, and the cylinder of the trim cylinder is integral with the attachment apparatus.

4. A tilt device for a marine propulsion unit as claimed in claim 2, wherein said cylinder device comprises a tilt cylinder and a trim cylinder, and the cylinder of the trim cylinder is integral with the attachment apparatus.

5. A tilt device for a marine propulsion unit as claimed in claim 3, wherein the cylinder of said trim cylinder is integral with the attachment apparatus.

6. A tilt device for a marine propulsion unit as claimed in claim 4, wherein the cylinder of said trim cylinder is integral with the attachment apparatus.

7. A tilt device for a marine propulsion unit as claimed in claim 1, wherein the oil passage connecting said hydraulic fluid supply/discharge device to the cylinder device is within the attachment apparatus.

8. A tilt device for a marine propulsion unit as claimed in claim 2, wherein the oil passage connecting said hydraulic fluid supply/discharge device to the cylinder device is within the attachment apparatus.

9. A tilt device for a marine propulsion unit as claimed in claim 3, wherein the oil passage connecting said hydraulic fluid supply/discharge device to the cylinder device is within the attachment apparatus.

10. A tilt device for a marine propulsion unit as claimed in claim 4, wherein the oil passage connecting said hydraulic fluid supply/discharge device to the cylinder device is within the attachment apparatus.

11. A tilt device for a marine propulsion unit as claimed in claim 5, wherein the oil passage connecting said hydraulic fluid supply/discharge device to the cylinder device is within the attachment apparatus.

12. A tilt device for a marine propulsion unit as claimed in claim 6, wherein the oil passage connecting said hydraulic fluid supply/discharge device to the cylinder device is within the attachment apparatus.

13. A tilt device for a marine propulsion unit as claimed in claim 7, wherein the tilt cylinder constituting said cylinder device is connected to both of the clamp bracket and the swivel bracket via a mounting pin, and the oil passage connecting said hydraulic fluid supply/discharge device to the tilt cylinder is installed within the mounting pin.

14. A tilt device for a marine propulsion unit as claimed in claim 8, wherein the tilt cylinder constituting said cylinder device is connected to both of the clamp bracket and the swivel bracket via a mounting pin, and the oil passage connecting said hydraulic fluid supply/discharge device to the tilt cylinder is installed within the mounting pin.

15. A tilt device for a marine propulsion unit as claimed in claim 9, wherein the tilt cylinder constituting said cylinder device is connected to both of the clamp bracket and the swivel bracket via a mounting pin, and the oil passage connecting said hydraulic fluid supply/discharge device to the tilt cylinder is installed within the mounting pin.

16. A tilt device for a marine propulsion unit as claimed in claim 10, wherein the tilt cylinder constituting said cylinder device is connected to both of the clamp bracket and the swivel bracket via a mounting pin, and the oil passage connecting said hydraulic fluid supply/discharge device to the tilt cylinder is installed within the mounting pin.

17. A tilt device for a marine propulsion unit as claimed in claim 11, wherein the tilt cylinder constituting said cylinder device is connected to both of the clamp bracket and the swivel bracket via a mounting pin, and the oil passage connecting said hydraulic fluid supply/discharge device to the tilt cylinder is installed within the mounting pin.

18. A tilt device for a marine propulsion unit as claimed in claim 12, wherein the tilt cylinder constituting said cylinder device is connected to both of the clamp bracket and the swivel bracket via a mounting pin, and the oil passage connecting said hydraulic fluid supply/discharge device to the tilt cylinder is installed within the mounting pin.

* * * * *